US006251159B1

(12) United States Patent
Angeliu et al.

(10) Patent No.: US 6,251,159 B1
(45) Date of Patent: Jun. 26, 2001

(54) DISPERSION STRENGTHENING BY NANOPHASE ADDITION

(75) Inventors: Thomas Martin Angeliu, Clifton Park; Charles Gitahi Mukira, Watervliet, both of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/218,635

(22) Filed: Dec. 22, 1998

(51) Int. Cl.[7] ..... C21D 10/00

(52) U.S. Cl. ..... 75/414; 75/560; 75/566; 148/320; 164/91; 164/97; 420/590

(58) Field of Search ..... 164/91, 97; 420/590; 75/414, 560, 566; 148/320

(56) References Cited

U.S. PATENT DOCUMENTS 5,192,497 * 3/1993 Sato ..... 420/581
5,246,057 * 9/1993 Hansson et al. ..... 164/97
5,305,817 * 4/1994 Borisov et al. ..... 164/97
5,358,687 * 10/1994 Ichikawa et al. ..... 420/590
5,401,338 * 3/1995 Lin ..... 420/590
5,589,652 * 12/1996 Arato et al. ..... 75/235
5,590,387 * 12/1996 Schmidt et al. ..... 419/36

FOREIGN PATENT DOCUMENTS

0131797 * 1/1985 (EP) ..... 164/97

* cited by examiner

*Primary Examiner*—Melvyn Andrews
(74) *Attorney, Agent, or Firm*—Robert P. Santandrea; Noreen C. Johnson

(57) ABSTRACT

A dispersion strengthening method for metallic melts that are used to form large articles. The method comprises adding nanophase particles into a molten metallic melt and dispersing the nanophase particles in the metallic melt. The nanophase particles comprising particles with diameters in the range of about 5 nanometers to about 100 nanometers. The step of dispersing the nanophase particles in the metallic melt spaces the particles from each other with an average interparticle spacing (IPS) in a range from about 10 nanometers to about 500 nanometers.

25 Claims, 4 Drawing Sheets

DISPERSION STRENGTHENING BY NANOPHASE ADDITION

BACKGROUND OF THE INVENTION

The invention relates to dispersion strengthening methods for metals. In particular, the invention relates to artificial dispersion strengthening methods for metals.

Dispersion strengthening enhances creep rupture strength of materials. Dispersion strengthening typically occurs by introducing a fine dispersion of particles into a material, for example a metal matrix. Dispersion strengthening can occur naturally by adding material constituents that form particles when the constituents are added over their solubility limits. Alternatively, dispersion strengthening can occur artificially by adding stable particles to a material, in which these particles are not naturally occurring in the material. These particles strengthen the material and are not altered during metallurgical processing. Typically, the closer the particles, the stronger the material. The fine dispersion of close particles restricts dislocation movement, and thus strengthens the material, in particular the creep rupture strength.

FIG. 1 is an exemplary graph of creep rupture strength versus interparticle spacing (IPS), which is provided in namometers. The graph illustrates two solid curves, curves C1 and C2, that represent naturally occurring dispersion strengthened creep rupture strength data for Fe-9 and 12Cr steel at 550° C. and 600° C., respectively. The dashed curve, curve C3, represents a generalized relationship of creep rupture strength versus IPS, using Orowan stress $\tau$ (MPa) that is calculated from the equation: $\tau=\{Gb\ln(D/b)\}/\{2\Pi(\lambda-D)\}$, where G is shear modulus, b is Burger's vector, D is the diameter of the particle, and $\lambda$ is the interparticle spacing. As indicated by the curves, creep rupture strength is increased with a decrease in IPS, especially evident at low IPS (FIG. 1). A high IPS provides lower creep rupture strengths. Low creep rupture strengths are undesirable, especially in high temperature applications.

Dispersion strengthening is decreased when the spacing between the particles increases. It is believed that the spacing is increased as the particles are acted upon by physical forces to dissolve, age, convert, or transform them into different particles. These changes are due to the particles being thermally unstable and change at different temperatures or with increased time in some temperature ranges.

FIG. 2 is a graph that illustrates creep rupture strength resistance versus time for a naturally dispersion strengthened material. The curves indicate that as a metal is aged (time increases), creep rupture strength provided by naturally dispersed particles decreases due to the particles being dissolved in their metal matrix, coarsened, or otherwise changed. Any changed particles are typically spaced further apart from each other so as to reduce dispersion strengthening.

Prior artificial dispersion strengthening processes have added particles, for example particles on the order of microns in size, to molten metal, which was then cast. Particles have been added to a molten metal and optionally stirred therein. These methods did not effectively disperse the particles in the molten metal casting. The particles were too light and floated on a surface of the melt, were too heavy and sank to the melt bottom under the influence of gravity, clumped together and did not disperse, or combinations thereof. Therefore, these prior methods did not produce a dispersion strengthened metal, which is believed due to the particle size being too large.

Another prior artificial dispersion strengthening method comprised spraying particles onto a stream of molten metal. This spraying method generally requires many steps to prepare the molten metal stream, and spray. Also, this spraying process was a very lengthy process. The metal stream must flow at rates of about one (1) pound/minute (about 0.38 kilogram/minute) to provide a sufficient amount of particles in the form of a particle spray to the stream. This stream flow rate leads to long process times, especially for large articles that weigh over about 500 lb. (about 225 kilograms). Also, some of the sprayed particles did not intersect with the stream, and are thus were not utilized. Therefore, this spraying method was inefficient and timely.

Another prior artificial dispersion strengthening process attempted to add mechanically alloyed particles, for example on the order of microns in size, to a material. Mechanically alloying particles and their associated formation processes are known in the art. Typically, processes used to form mechanically alloyed particle-dispersion strengthened articles comprise powder metallurgy (PM) processes. The PM processes include, but are not limited to, hot isostatic pressing (HIP) processes, which are known in the art. PM processes have inherent size limitations in which PM production is limited to small articles (those articles that have a diameter less than about 8 inches (20 centimeters)). PM processes are impractical for dispersion strengthening of large metal articles, such as large power generation equipment including rotors for steam turbines.

Therefore, an effective dispersion strengthening method that enhances creep rupture strength for metals is needed, especially for large articles. The dispersion strengthening method should create a dispersion strengthened metal with closely spaced, uniformly dispersed, thermally stable, fine particles.

SUMMARY OF THE INVENTION

The invention provides a dispersion strengthening method for metals that are used to form articles. The method comprises adding nanophase particles into a molten metallic melt and dispersing the nanophase particles in the metallic melt. The nanophase particles comprise particles with diameters in the range of about 5 nanometers to about 100 nanometers.

These and other aspects, advantages and salient features of the invention will become apparent from the following detailed description, which, when taken in conjunction with the annexed drawings, where like parts are designated by like reference characters throughout the drawings, disclose embodiments of the invention.

DESCRIPTION OF THE INVENTION

The dispersion strengthening method, as embodied by this invention, comprises adding fine, thermally stable, particles, such as nanophase particles, to a metallic melt. The dispersion strengthening method can be used to produce large dispersion strengthened articles, where large articles are those that weigh over about 500 lb. (about 225 kilograms) and have diameters or widths greater than about 8 inches (20 centimeters). The nanophase particles, which are within the scope of the invention, comprise fine nanophase particles with diameters less than or equal to about 100 nanometers, for example diameters in a range of about 5 nanometers (nm) to about 100 nanometers (nm). The nanaphoase particles are provided in the metal with an interparticle spacing (IPS) between nanophase particles to enhance the dispersion strengthening of the material.

The nanophase materials are thermally stable. Thermally stable, within the scope of the invention, means that the particles do not dissolve, age, convert, or transform into different particles over time or when subject to elevated temperatures.

Nanophase materials, as embodied by the invention, include, but are not limited to, oxides, intermetallics, metals and alloys, carbides, nitrides, and silicides. Exemplary nanophase particles, within the scope of the invention, include cerium oxide (CeO), tungsten carbide (WC), niobium carbide (NbC), and vanadium nitride (VN). Nanophase particles may be produced by any appropriate process including, but not limited to, spray drying, sol-gel forming, gas phase condensation, and powder manufacturing to produce nanophase particles. Any process for forming nanophase particles is within the scope of the invention.

Figure 3:
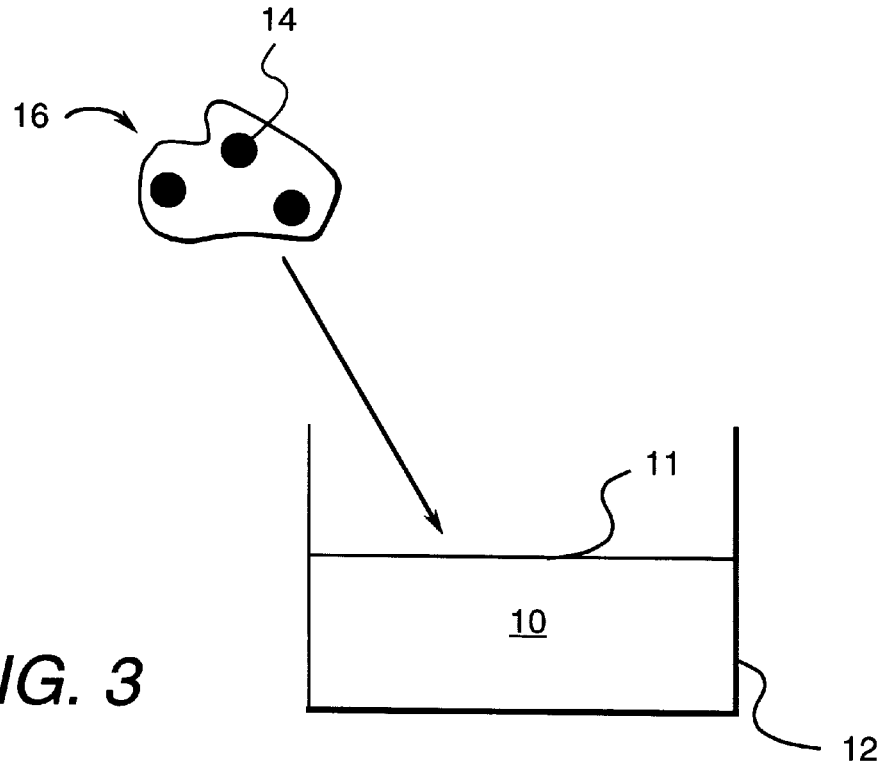
FIG. 3 is a schematic illustration of a dispersion strengthening method.

A dispersion strengthening method, as embodied by the invention, will now be described with reference to FIG. 3 and the flowchart of FIG. 4. A metallic melt 10, such as, but not limited to, a high temperature metal, is provided in step 51. The high temperature metal includes, but is not limited to, steels, superalloys (including iron-, nickel-, iron/nickel-, and cobalt-based superalloys), and other metals. The metallic melt 10 may be melted in a furnace, crucible or other appropriate device 12.

Nanophase particles 14 may be added to the metallic melt 10 in step 52. The nanophase particles 14 may be added directly to the melt 10. Alternatively, the nanophase particles 14 may be added as part of a master alloy 16 (to be described hereinafter) and will be uniformly dispersed in the metallic melt 10. The nanophase particles 14 are added to the metallic melt 10 at any time prior to casting (processing) the metallic melt 10 into an article. The timing of nanophase particle 14 addition to the metallic melt 10 typically will not alter dispersion strengthening.

The nanophase particles 14 can be added to the metallic melt 10 by any appropriate process. For example, and in no way limiting of the invention, the nanophase particles 14 can be injected under a top surface 11 of the metallic melt 10. Alternatively, the nanophase particles 14 can be added to the metallic melt 10 on the top surface 11 and mixed into the metallic melt 10.

The nanophase particles 14 that are added to the metallic melt 10 may be incorporated into the master alloy 16. The master alloy 16 comprises an enriched volume of nanophase materials in a binder 18 of suitable material. The master alloy 16 may also comprise a dispersing agent, such as, but not limited to, niobium, manganese, tantalum, cerium oxide, combinations thereof, and other appropriate dispersing agents. The binder 18 is selected from a group comprising metallic, non-organic, organic, and materials, in either solid or liquid phases. The following discussion will refer to a binder 18 and nanophase particles 14 in a nanophase master alloy 16, however this discussion is merely exemplary and is not meant to limit the invention in any way. The master alloy can comprise a dispersing agent in addition to the binder 18.

The binder 18 of the nanophase master alloy 16 may comprise a shear material, which will be consumed, such as by being burned off by the metallic melt 10. These shear materials include, but are not limited to, polymers, ceramics, plastics, and other materials that are capable of being consumed by the metal melt 10 and do not adversely effect properties of the metal melt 10.

As a further alternative, the binder 18 can comprise a constituent of the metallic melt 10. For example, if the metallic melt 10 comprises a high temperature steel alloy, such as Fe-12Cr (Fe-12Cr comprises iron, chromium, carbon, cobalt, and other constituents), the nanophase master alloy 16 can comprise the nanophase particles 14 with a binder 18 comprising one or more of the metallic melt's constituents. The binder 18 comprises sufficient amounts of the metallic melt's constituent to provide the final metallic melt's with the desired levels of the constituent.

Figure 6:
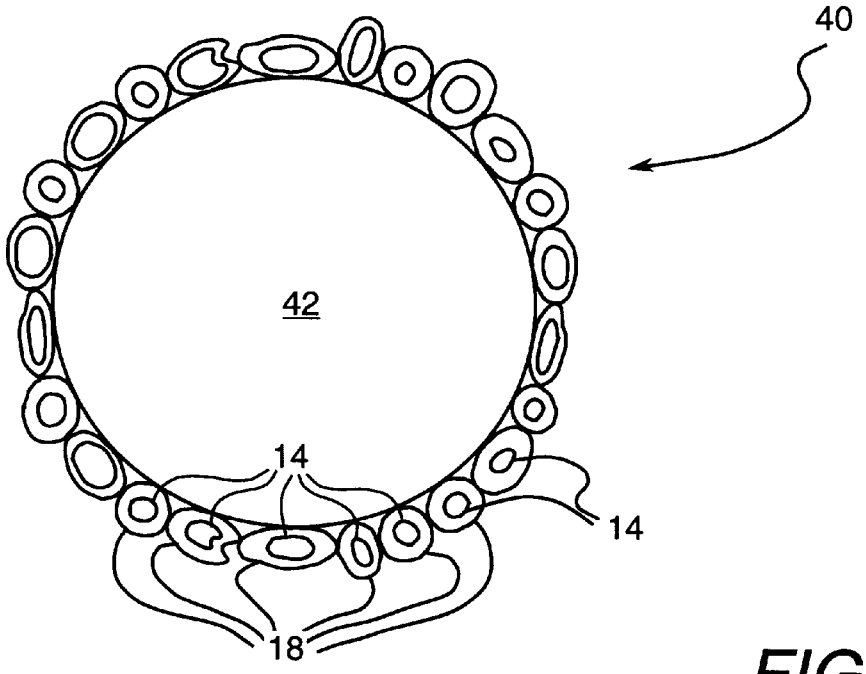
FIG. 6 is a part-sectional, schematic illustration of another nanophase master alloy.

Another nanophase master alloy 16 alternative, as embodied by the invention, comprises a master alloy sphere 40, as illustrated in FIG. 6. The master alloy sphere 40 is formed as a "ball" of coated nanophase particles 14. The nanophase particles 14 are coated by the binder 18 (as discussed above), and are formed into the master alloy sphere 40. Typically, the sphere 40 includes a layer of nanophase master alloy 16, and alternatively, the sphere 40 can comprise more than one layer of nanophase master alloy 16. The master alloy sphere 40 comprises a generally spherical configuration with a hollow interior 42. The hollow interior 42 of the nanophase master alloy sphere 40 is believed to promote an even dispersion of the nanophase particles 14 in the metallic melt 10. For example, the nanophase sphere 40 is deposited into a the metallic melt 10. The metallic melt 10 melts the binder 18 and allows the nanophase particles to disperse. The above-described nanophase master alloy forms are merely exemplary, and are not meant to limit the invention in any way.

Figure 4:
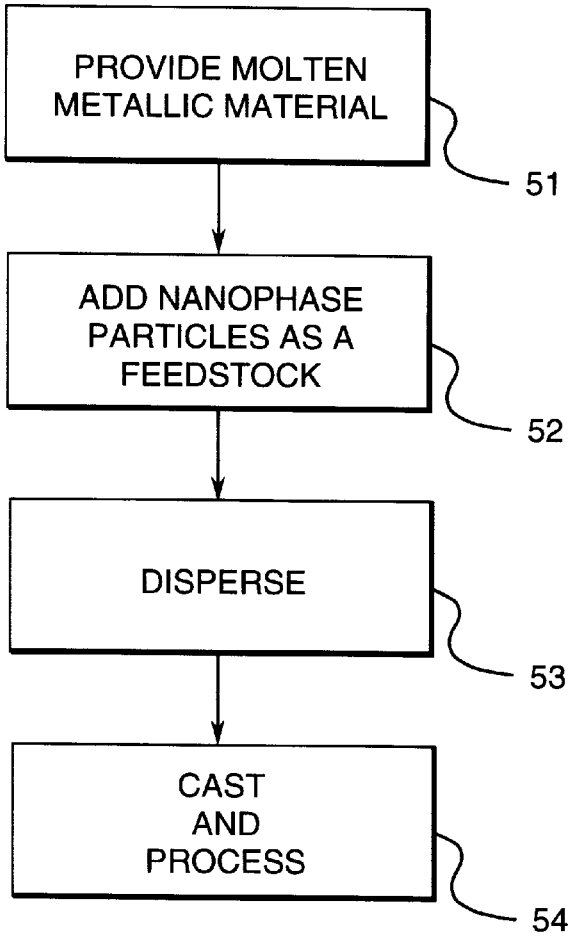
FIG. 4 is flowchart illustrating steps for a dispersion strengthening method.
Figure 5:
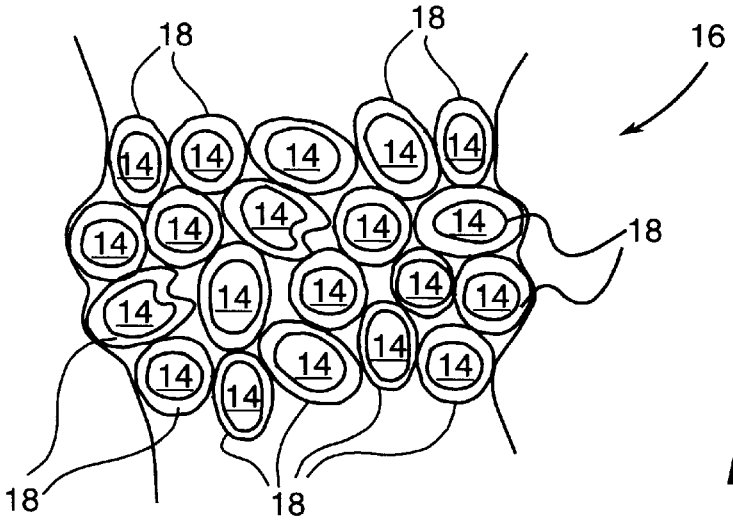
FIG. 5 is a part-sectional, schematic illustration of a nanophase master alloy.

The nanophase particles 14 are dispersed in the metallic melt 10 in step 53 (FIG. 4). The nanophase particles 14 will be dispersed in the metal melt 10, and achieve an average desired interparticle spacing (IPS) to produce creep rupture strengths and associated mechanical properties for the intended application. The dispersing of the nanophase particles 14 can occur by mixing the nanophase particles 14 into the metallic melt 10. The nanophase particles 14 can be mixed into and dispersed in the metallic melt 10 by convection mixing from the heat of the metallic melt 10. Alternatively, the nanophase particles 14 may be mixed into the metallic melt 10 by an appropriate mixing device, such as a stirrer, electromagnetic mixing, forcing gas mixing, physical mixing devices, and combinations thereof.

Figure 1:
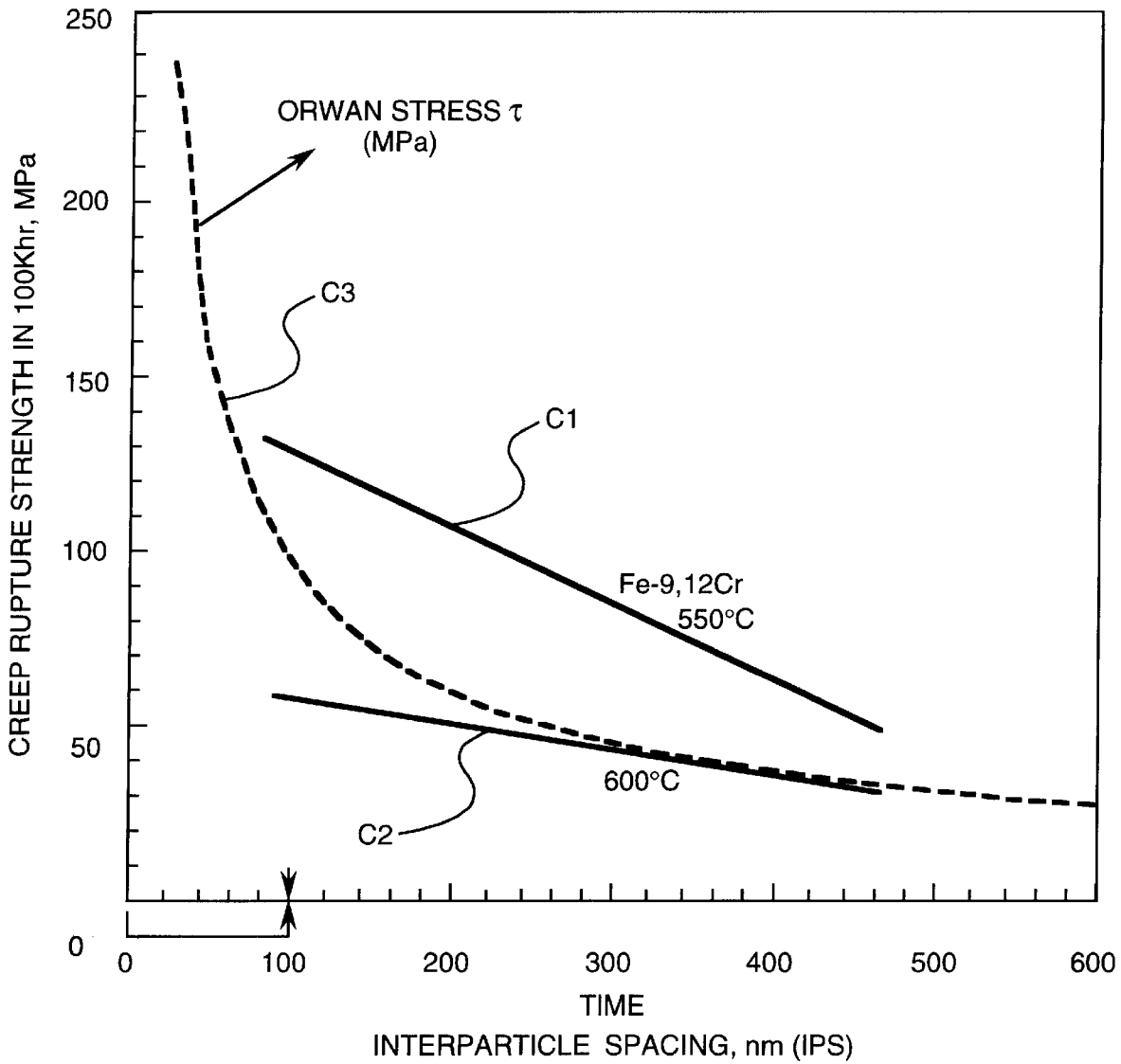
FIG. 1 is a graph of interparticle spacing versus creep rupture strength.
Figure 2:
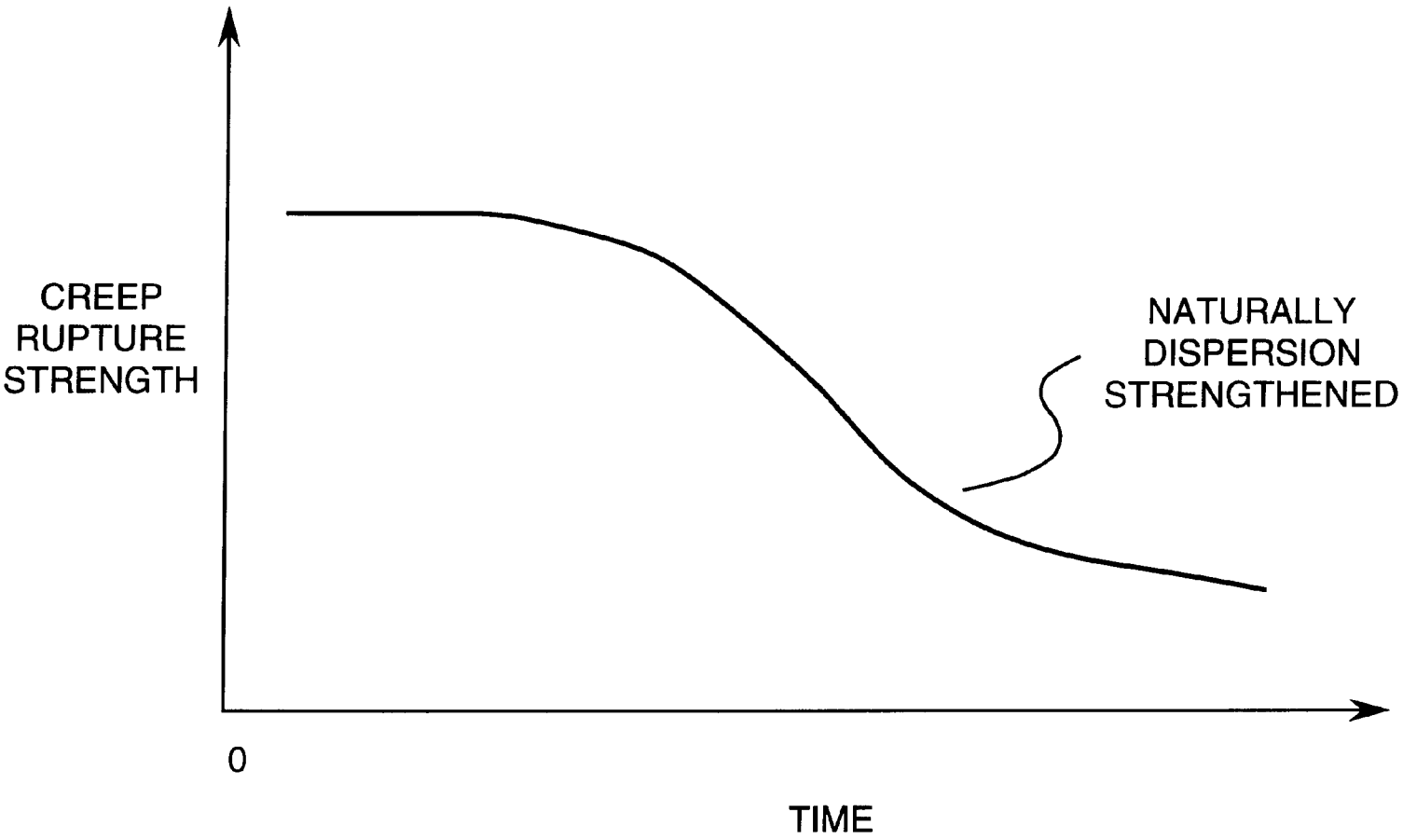
FIG. 2 is a graph that illustrates generalized creep rupture strength resistance versus time.

The nanophase particles 14 are dispersed in the metallic melt 10 and are spaced with an IPS that promotes creep rupture strength. A small IPS, such as less than about 100 nm, provides smaller and more nanophase particles 14 dispersed in the metallic melt 10. Therefore, enhanced dispersion strengthening of the resultant large metal article with a high creep rupture strength, also as illustrated in FIG. 1 can be achieved. Exemplary IPSs, within the scope of the invention, that provide desired creep rupture strengths and associated mechanical properties for the intended application, are typically in a range from about 10 nm (nanometers) to about 500 nm. An alternative IPS, as embodied by the invention, is in a range from about 10 nm to about 250 nm, and another alternative IPS is about 100 nm. In general, a small IPS provides a resultant, large, dispersion strengthened metal article having a high creep rupture strength.

The nanophase particles 14, in accordance with the invention, are thermally stable. Thus, these nanophase particles 24 do not transform, convert, age or otherwise change when subjected over time to elevated temperatures, such as those encountered in power generation applications. The nanophase particles 14 also possess a balanced size and density to remain dispersed in the melt 10. Therefore, these nanophase particles 14 remain dispersed in the metal melt 10 (or in the casting when poured for forming the article), and are not too heavy so that they sink to the bottom of the metal melt 10 nor are they too light so they float on a surface of the casting or metal melt 10.

The nanophase particles 14 are small, for example with a balanced size in a range from about 5 nm to about 100 nm. Therefore, Brownian motion will maintain the nanophase particles 14 in the molten melt 10 as a colloidal suspension until solidification. The metallic melt 10 can then be processed into a large casting, and subsequent large, article in step 54. The processing step 54 includes, but is not limited to, solidifying, forging, working and other metallurgical processes. Use of heat treatments, as known in the art, of these artificially dispersion strengthened materials to dispersion strengthen the materials is also within the scope of the invention. The resultant large metal article is a dispersion strengthened metal article. An example of a large article is a rotor for a steam turbine that weighs over about 500 lb. (about 225 kilograms), and up to several tons. Further, the large article may exceed a diameter of about 8 inches (20 centimeters)).

While various embodiments are described herein, it will be appreciated from the specification that various combinations of elements, variations or improvements therein may be made by those skilled in the art, and are within the scope of the invention.

What is claimed is:

1. A dispersion strengthening method for metals, the method comprising the steps of:

adding mechanically alloyed nanophase particles into a metallic melt, the mechanically alloyed nanophase particles comprising particles with diameters in the range of about 5 nanometers to about 100 nanometers; and dispersing the mechanically alloyed nanophase particles in the metallic melt so the mechanically alloyed nanophase particles are spaced from each other to provide dispersion strengthening.

2. The method according to claim 1, the method further comprising a step of processing the metallic melt into an article.

3. The method according to claim 1, wherein the step of processing the metallic melt comprises forming an article that weighs over about 225 kilograms and has a diameter greater than about 0.3 meters.

4. The method according to claim 1, wherein the step of dispersing comprises mixing the mechanically alloyed nanophase particles in the metallic melt.

5. The method according to claim 4, wherein the step of mixing comprises at least one of convection mixing from the heat of the metallic melt, stirring, electro-magnetic mixing, forced gas mixing, thermal spray mixing, and combinations thereof.

6. The method according to claim 1, wherein the step of adding the nanophase particles comprises adding thermally stable particles.

7. The method according to claim 1, wherein the step of adding nanophase particles comprises selecting nanophase particles from the group consisting of:

cerium oxide (CeO), tungsten carbide (WC), niobium carbide (NbC), and vanadium nitride (VN).

8. The method according to claim 1, wherein the interparticle spacing is in a range from about 10 nanometers to about 500 nanometers.

9. The method according to claim 1, wherein the interparticle spacing is in a range from about 10 nanometers to about 250 nanometers.

10. The method according to claim 1, wherein the interparticle spacing is less than about 100 nanometers.

11. The method according to claim 1, wherein the step of adding mechanically alloyed nanophase particles comprises adding the mechanically alloyed nanophase particles with a dispersing agent.

12. The method according to claim 1, wherein the step of adding the mechanically alloyed nanophase particles comprises:

injecting the mechanically alloyed nanophase particles under a top surface of the metallic melt.

13. A dispersion strengthening method for metals, the method comprising:

adding nanophase particles into a molten metallic melt, the nanophase particles comprising particles with diameters in the range of about 5 nanometers to about 100 nanometers;

the step of adding nanophase particles comprises adding a master alloy that comprises the nanophase particles; and dispersing the nanophase particles in the metallic melt so nanophase particles are spaced from each other to provide dispersion strengthening.

14. A method according to claim 13, wherein the step of adding a master alloy comprises:

saturating the nanophase particles in a portion of the metallic melt to create a saturated portion of metallic melt; and distributing the saturated portion of the metallic melt to the metallic melt.

15. The method according to claim 13, wherein the step of adding the master alloy comprises:

adding the nanophase particles to a shear material; and adding the shear material and nanophase material to the metallic melt.

16. The method according to claim 13, wherein the step of adding a master alloy comprises adding the nanophase particles and a binder.

17. The method according to claim 16, wherein the step of adding the nanophase particles and a binder comprises adding a binder that comprises a constituent of the metallic melt.

18. The method according to claim 16, wherein the step of adding the nanophase particles and a binder comprises adding a master alloy sphere.

19. A dispersion strengthening method for metals, the method comprising:

adding nanophase particles into a molten metallic melt, the nanophase particles comprising particles with diameters in the range of about 5 nanometers to about 100 nanometers;

the step of adding nanophase particles comprises adding mechanically alloyed particles; and dispersing the nanophase particles in the metallic melt so nanophase particles are spaced from each other to provide dispersion strengthening.

20. A dispersion strengthening method for metals, the method comprising the steps of:

adding a master alloy into a molten metallic melt, the master alloy comprising nanophase particles having diameters in the range of about 5 nanometers to about 100 nanometers; and dispersing the master alloy in the metallic melt so the nanophase particles are spaced from each other to provide dispersion strengthening.

21. The method according to claim 20, wherein the step of adding a master alloy comprises:

saturating the nanophase particles in a portion of the metallic melt to create a saturated portion of metallic melt; and distributing the saturated portion of the metallic melt to the metallic melt.

22. The method according to claim 20, wherein the step of adding the master alloy comprises:

adding the nanophase particles to a shear material; and adding the shear material and nanophase material to the metallic melt.

23. The method according to claim 20, wherein the step of adding a master alloy comprises adding the nanophase particles and a binder.

24. The method according to claim 23, wherein the step of adding the nanophase particles and a binder comprises adding a binder that comprises a constituent of the metallic melt.

25. The method according to claim 23, wherein the step of adding the nanophase particles and a binder comprises adding a master alloy sphere.

* * * * *